United States Patent [19]

Oulton

[11] 4,011,486

[45] Mar. 8, 1977

[54] TONE OPERATED SWITCHING ARRANGEMENT

[75] Inventor: David B. Oulton, Dollard des Ormeaux, Canada

[73] Assignee: Pylon Electronic Development Company, Ltd., Lachine, Canada

[22] Filed: Mar. 27, 1975

[21] Appl. No.: 562,804

[52] U.S. Cl. ..... 361/182; 307/129; 340/171 R

[51] Int. Cl.[2] ..... H01H 47/20

[58] Field of Search ..... 317/147; 307/116, 117, 307/129; 179/84 VF; 340/147 F, 171 R, 298, 299, 313, 172.5; 331/65

[56] References Cited

UNITED STATES PATENTS

| | | | |
|---|---|---|---|
| 3,440,347 | 4/1969 | Spencer et al. | 317/147 X |
| 3,651,474 | 3/1972 | Liberman | 340/172.5 |
| 3,784,848 | 1/1974 | Hamilton | 331/65 X |
| 3,835,454 | 9/1974 | Palmieri et al. | 340/171 R |

*Primary Examiner*—Harry Moose

[57] ABSTRACT

Disclosed is a switching arrangement operable by a tone of a predetermined frequency. An automatic gain control amplifier has an input connectable to a source of signals and an output connected to an input of a bandpass filter which rejects all frequencies except those of a narrow band centered on the predetermined frequency. The bandpass filter is connected to an input of a phase locked loop which produces a change in voltage from a first level to a second level at its output only in response to a narrow band of frequencies centered on the predetermined frequency. The output of the phase locked loop is connected to a timer which only produces a pulse at its output upon receipt of the second level of voltage for a predetermined time. A pulse from the timer is fed to a flip-flop which changes state and operates a relay. The arrangement is particularly useful in loop-back unit whereby equipment may be disconnected from a receive line and a transmit line and the two lines connected together for testing purposes.

6 Claims, 2 Drawing Figures

TONE OPERATED SWITCHING ARRANGEMENT

BACKGROUND OF THE INVENTION

This invention relates to a switching arrangement operable by a tone of a predetermined frequency and in particular to a loop-back unit utilizing such a switching arrangement.

Various establishments, for example banks, department stores, etc., use computers and sometimes transmit and receive data over communication lines, for example, telephone lines. If problems develop in the transmission and/or receiption of data over the telephone lines, it becomes necessary to determine whether the problem exists in the telephone lines (or related equipment) or in the customer's equipment, that is, his computer or equipment interfacing the computer with the telephone lines. For this reason, it is desirable for the telephone company to be able to determine easily whether or not the problem exists in their equipment or in the customer's equipment and it is preferable if this can be determined without having to send a service man to the customer's premises, i.e. if it can be done remotely. The present invention enables this to be done by setting up a connection at the customer's premises such that signals can be sent and received to and from the customer's premises without going through his equipment, i.e. his computer or other data equipment. This is called "looping back" and, according to the invention, the looping back is initiated by a tone sent over the telephone line to a loop-back unit located at the customer's premises.

SUMMARY OF THE INVENTION

In accordance with the invention there is provided a switching arrangement operable by a tone of a predetermined frequency comprising an automatic gain control amplifier having an input connectable to a source of signals and an output connected to an input of a bandpass filter which rejects all frequencies except those of a narrow band centered on said predetermined frequency. The bandpass filter is connected to an input of a phase locked loop which produces a change in voltage from a first level to a second level at its output only in response to a narrow band of frequencies centered on said predetermined frequency, the output of said phase locked loop being connected to a timer which only produces a pulse at its output upon receipt of said second level of voltage for a predetermined time, a pulse from said timer being fed to a flip-flop which changes state and operates a relay.

In a preferred embodiment the relay operates to disconnect a receive line and a transmit line from a piece of equipment (e.g. a computer) and to set up a connection (loop-back) between the receive line and transmit line.

BRIEF DESCRIPTION OF THE DRAWING

The invention will now be further described in conjunction with the accompanying drawings, in which.

DESCRIPTION OF THE PREFERRED EMBODIMENTS

Figure 1:
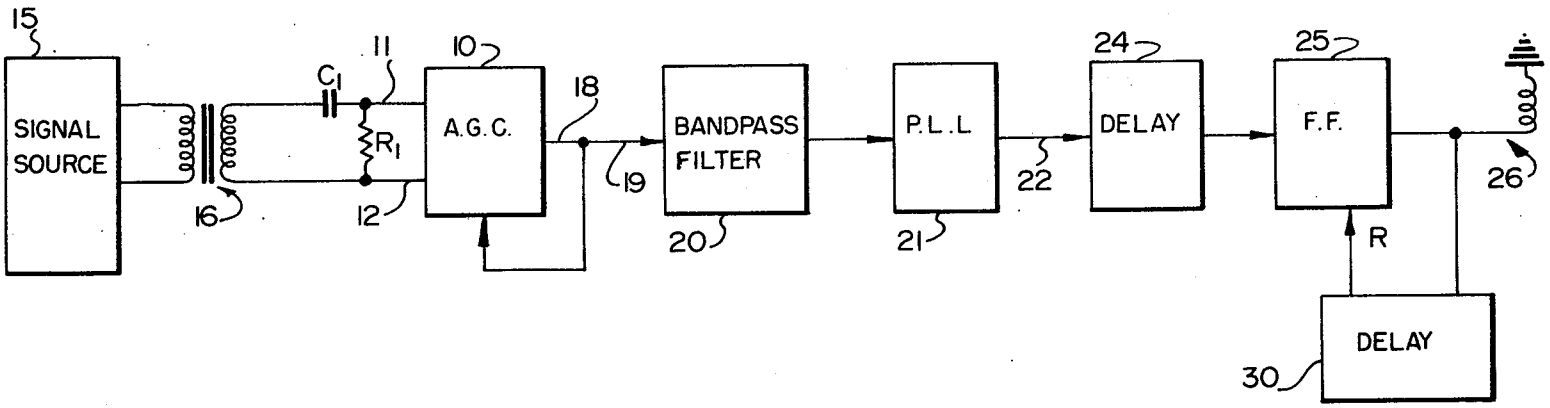
FIG. 1 is a block diagram of a switching arrangement according to the invention.

Referring to FIG. 1, the switching arrangement is operable by a tone of a predetermined frequency. The arrangement comprises an automatic gain control amplifier 10 having an input comprising leads 11 and 12 which is connectable to a source of signals. Although not essential to the invention, the signal source 15 is here shown connected to the input of the automatic gain control amplifier 10 via an impedence matching transformer 16 and a filter comprising $C_1$ and $R_1$, the filter eliminating unwanted low frequencies.

the output 18 of the automatic gain control amplifier 10 is connected to an input 19 of a bandpass filter 20 which rejects all frequencies except those of a narrow band centered on a predetermined frequency. The output of the bandpass filter 20 is connected to an input of a phase locked loop (P.L.L.) 21 which produces a change in voltage from a first level to a second level at its output 22 only in response to a very narrow band of frequencies centered on said predetermined frequency. The output of the phase locked loop 21 is connected to a delay or timer 24 which only produces a pulse at its output upon receipt of said second level of voltage for a predetermined time. A pulse from the timer is fed to a flip-flop 25 which changes state and operates a relay 26.

The output of the flip-flop 25 also operates a second timer 30 which, after a predetermined time delay, resets the flip-flop 25 via the line designated R.

Both the timers 24 and 30 are preferably adjustable.

In an application as a loop-back unit involving the use of telephone lines, the frequency range of the incoming signal would be limited to the voice band. The lower end of the voice band may be limited by the filter comprising $C_1$ and $R_1$.

The level of the largest signal coming into the AGC amplifier 10 is amplified or attenuated to bring the level to a pre-set value. For example, the signal may be amplified or atenuated over a range of +40 to −40 db.

It is to be noted that the automatic gain control amplifier 10 precedes the bandpass filter 20. If the bandpass filter were to pecede the AGC amplifer, the arrangement would have maximum sensitivity all the time for the center frequency of the bandpass filter. However, this is not desired in the present invention and, hence, the AGC amplifier precedes the bandpass filter. With this arrangement, sensitivity is set by the largest amplitude frequency that is presented to the input. Thus, when data signals or other signals which are not at the operating frequency of the unit are present, the unit will not respond to low levels of the normal operating frequency and thus falsely trigger the unit as would a circuit where the bandpass filter precedes the AGC amplifier. When no signals other than the operational frequency are used, the unit has its maximum sensitivity. During testing, of course, there would normally be no signals other than the operational frequency.

The bandpass filter 20 may have a Q of 15 and it rejects all but the wanted bandpass frequency.

The phase locked loop 21 receives only a narrow band of frequencies and it has a narrow band width of response of, for example, ±1%.

The output of the delay (timer) 24 is only given if the signal remains on for the delay period which is set. Thus, false noise bursts will not give any output and hence will not trigger the flip-flop 25.

The flip-flop 25 is used as a memory device and this activates the relay 26.

Figure 2:
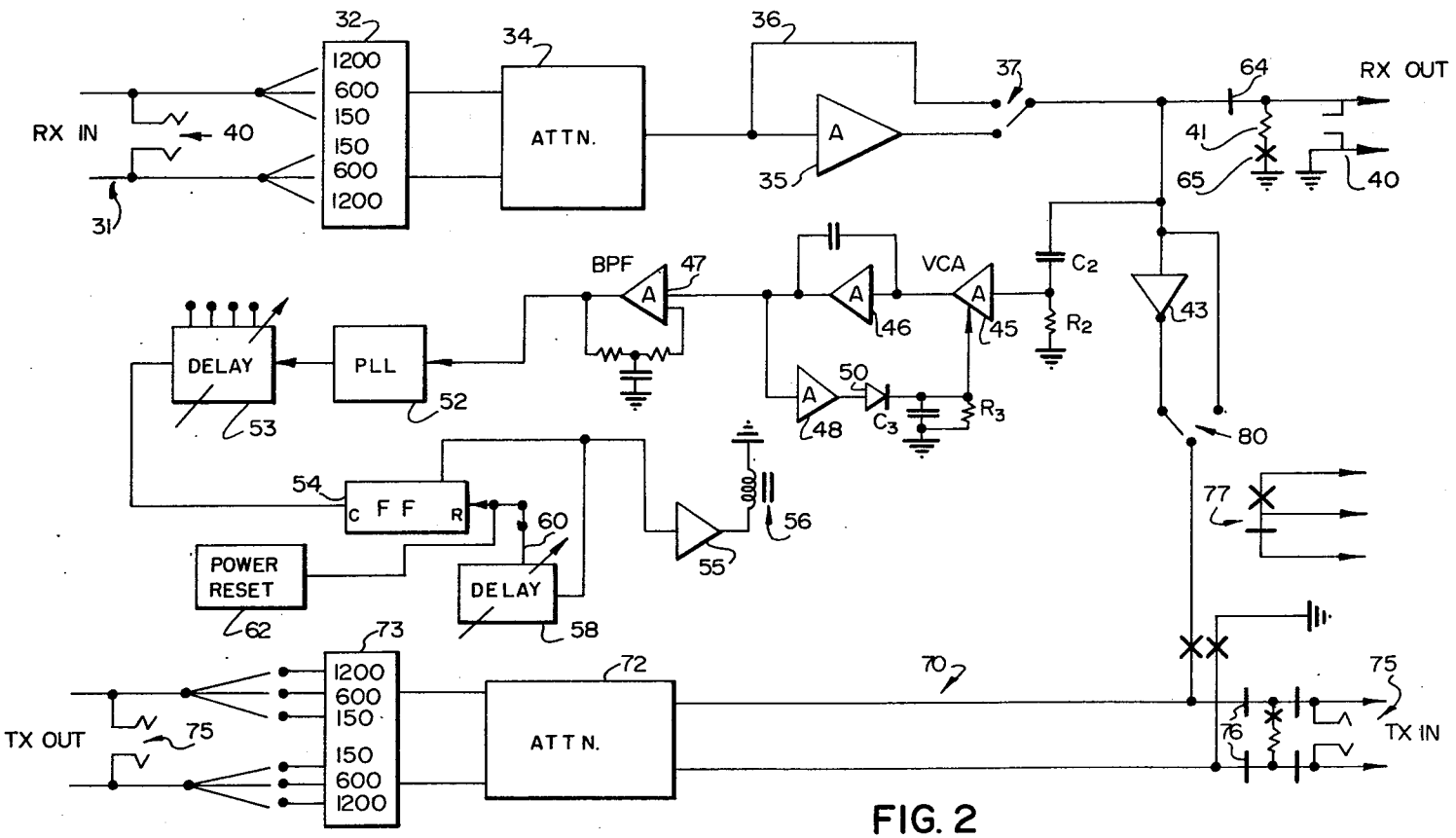
FIG. 2 is a block diagram of a loop-back unit utilizing a switching arrangement according to the invention.

Referring to FIG. 2, the receive line input 31 of the loop-back unit is fed into a balanced line matching transformer 32 with either 150,600 or 1200 ohms input impedance. The output of the transformer 32 is 600 ohms. The output of the transformer 32 is then connected to a 600 ohm attenuator 34 which may have a range of 0 to 31 ¾ db in ¼ db increments and then fed to an amplifier 35 with +10 db gain which is connected to the output terminals for the receive line. If desired, the amplifier 35 may be bypassed via line 36 by means of change over switch 37.

A jack 40 is provided in the receive input line to the transformer 32 and in the output of the amplifier 35 so that the level at these points may be measured. When a plug is inserted into the jack, the drop side of the jack is terminated by a 600 ohm resistor 41.

The output of the receive line aplifier 35 is fed to a loop amplifier 43 with a gain of, for example, 16 db, and also to a frequency filter network consisting of $C_2$ and $R_2$. The output of this filter is connected to the input of a voltage controlled amplifier 45 which has a range in gain of, for example, −40 to +40 db. The output of the voltage controlled amplifier 45 is connected to a frequency compensated amplifier 46 which sends its signal to a frequency bandpass amplifier 47 and also to an amplifier 48 which has a rectifier 50 connected to its output and a filter network comprising resistor $R_3$ and capacitor $C_3$. The dc output voltage of this filter network $C_3$, $R_3$ is connected to a control terminal of the voltage controlled amplifier 45, thus forming a complete automatic gain controlled amplifier.

The frequency bandpass amplifier 47 may have a Q of 15 and a center frequency of 2713 Hz with ±90 Hz at the 3 db points. This frequency is desirable in applications involving the use of telephone lines as it is not normally used for anything else. The output of amplifier 47 is connected to a phase locked loop 52 which has a center frequency of 2713 Hz. and a band width of ±25 Hz. The phase locked loop 52 is preferably temperature compensated so as to maintain a ±8 Hz center frequency over the range of −20 to +50° C. The output of the phase locked loop 52 is a d.c. logic level which is connected to a programable timer or delay 53 that has a range of, for example, 1 second to 15 seconds in 1 second increments. The level of the output of the phase locked loop 52 must remain low longer than the time for which the timer 53 is preset. Otherwise, the timing circuit 53 will be reset and must start re-timing again.

When the timer 53, which corresponds to the timer 24 of FIG. 1, has timed its pre-set time and the signal from the phase locked loop 52 is present longer than this time, then an output pulse is coupled to a flip-flop 54 which will change state. The output of the flip-flop is connected to a relay driver 55 which will operate a loop back relay 56. The output of the flip-flop 54 is also connected to a delay or timer 58 that can be programed for a delay of, for example, 1 minute to 15 minutes, in 1 minute increments. The timer 58 begins timing as soon as the relay is activated and when the delay has timed out, it will reset the flip-flop 54 via line 60.

When the relay 56 is activated, its contacts 64 and 65 disconnect the output of the receive line output and terminate it with 600 ohms and the output of the loop back amplifier 43 is connected to the input of the transmit leg generally indicated at 70.

The transmit leg 70 has a 600 ohm attenuator 72 which can be adjusted from, for example, 0 to 31 ¾ db in ¼db steps. The output of the attenuator 72 is connected to a transformer 73 which has a selectable output impedance of 150,600 or 1200 ohms balanced. Monitoring jacks 75 are provided at both the transmit input and output with 600 ohm terminations provided to the drop side when plugs are inserted for measurement. When the relay 56 is activated (in loop-back), a red light emitting diode (not shown) provides an indication of this relay activation. The unit may also be activated by a local switch (not shown) or by an external loop (not shown). The input that normally comes into the transmit input is disconnected from the circuit and is terminated in 600 ohms during the loop-back condition by virtue of relay contacts 76. Other contacts generally indicated at 77 may also be extended to indicate the condition of the relay and to condition or signal external equipment connected to the unit.

The power supplied to operate the unit may be either a.c. or d.c. voltage. The input voltage is either rectified or polarity corrected by a diode bridge and is filtered. The output of the filter is connected to a voltage regulator, preferably an integrated circuit voltage regulator, with over-voltage and current limit protection built in. The output voltage of the regulator may be 12 volts to power part of the circuitry and an additional 5 volt integrated circuit voltage regulator, also with current limit protection built in, can supply the remaining circuitry.

A green light emitting diode may be provided to indicate when power is on and this green light emitting diode (not shown) would normally be located on the front panel of a suitable enclosure for the arrangement.

The unit contains an automatic power reset 62 so that when the unit is turned on or power is momentarily lost, it will return to a normal operating condition.

The timers 53 and 58 may comprise programable unijunction transistors with simple resistor-capacitor charging circuits connected with their anodes. The time delay is adjusted by simply varying the resistance, as by strapping out portions of a resistor or strapping out one or more resistors in a chain of resistors to vary the changing rate of the capacitor.

Amplifier 43 may, if not needed, be eliminated from the circuit by means of change over switch 80. Amplifiers 35 and 43 may, for example, be linear dual preamplifiers sold by National Semiconductor under their product designation LM 381 AN. However, it is obvious that any suitable amplifier could be used.

The bandpass frequency amplifier 46 may actually be a two-stage amplifier comprising an LM 381 AN and a LM 3900 N of National Semiconductor, for example.

The flip-flop 54 may be an MMFC 6050 of Motorola.

The phase locked loop 52 may be a "tone decoder" sold by National Semiconductor under their product designation LM 567.

The foregoing examples of suitable circuit components are, of course, not to be taken in a limiting sense as other suitable components could undoubtedly be used as will be obvious to those skilled in the art.

The attenuators 34 and 72 and amplifiers 35 and 43 are adjusted so that, during loop-back, the level of the tone received from the loop-back unit is substantially the same as that sent to it assuming, of course, no faults on the telephone lines to and from the loop-back unit.

I claim:

1. A switching arrangement operable by a tone of a predetermined frequency comprising an automatic gain control amplifier having a signal input, a control input and an output, the signal input being connectable to a source of signals and the output being connected to an input of a bandpass filter which rejects all frequencies except those of a narrow band centered on said predetermined frequency, said output also being connected to said control input whereby the sensitivity of the automatic gain control amplifier is adjusted to be a maximum for the largest amplitude frequency appearing at said signal input, said bandpass filter being connected to an input of a phase locked loop which produces a change in voltage from a first level to a second level at its output only in response to a narrow band of frequencies centered on said predetermined frequency, the output of said phase locked loop being connected to a timer which only produces a pulse at its output upon receipt of said second level of voltage for a predetermined time, a pulse from said timer being fed to a flip-flop which changes state and operates a relay.

2. An arrangement as claimed in claim 1 wherein said timer is adjustable.

3. An arrangement as claimed in claim 2 wherein said flip-flop also operates a second timer which, after a predetermined time delay, resets the flip-flop.

4. An arrangement as claimed in claim 3 wherein said second timer is adjustable.

5. An arrangement as claimed in claim 4 wherein said relay operates to disconnect a receive line and a transmit line from a piece of equipment and to set up a connection between the receive line and the transmit line.

6. An arrangement as claimed in claim 5 wherein said receive line comprises the source of signals.

* * * * *